United States Patent [19]

Fey et al.

[11] 3,989,511

[45] Nov. 2, 1976

[54] METAL POWDER PRODUCTION BY DIRECT REDUCTION IN AN ARC HEATER

[75] Inventors: Maurice G. Fey, Pittsburgh, Pa.; Edna A. Dancy, Beaconsfield, Canada

[73] Assignee: Westinghouse Electric Corporation, Pittsburgh, Pa.

[22] Filed: Mar. 10, 1975

[21] Appl. No.: 557,155

[52] U.S. Cl. ..... 75/.5 BB; 75/10 R

[51] Int. Cl.[2] ..... B22F 9/00

[58] Field of Search ..... 75/.5 B, .5 BB, 10 R

[56] References Cited

UNITED STATES PATENTS

| | | | |
|---|---|---|---|
| 3,475,158 | 10/1969 | Neuenschwander | 75/.5 BB |
| 3,765,870 | 10/1973 | Fey et al. | 75/11 |
| 3,851,136 | 11/1974 | Venus et al. | 75/.5 BB |
| 3,852,061 | 12/1974 | Wulff | 75/.5 BB |
| 3,862,834 | 1/1975 | Waclawiczek | 75/.5 B |

*Primary Examiner*—W. Stallard

*Attorney, Agent, or Firm*—L. P. Johns

[57] ABSTRACT

A process for the production of metal powder from an ore by direct reduction in an arc heater characterized by the steps of introducing a finely divided ore into a plasma arc to effect direct reduction of the ore to small solid particles of elemental metal in a reducing atmosphere and quenching the metal particles to form solid metal powder, the metal having a melting point greater than the temperature of the chemical reduction reaction, such metal being, for example, molybdenum, tungsten, tantalum, or niobium.

1 Claim, 2 Drawing Figures

METAL POWDER PRODUCTION BY DIRECT REDUCTION IN AN ARC HEATER

CROSS REFERENCE TO RELATED APPLICATION

This invention is related to the copending application of Maurice G. Fey and Edna A. Dancy, entitled "Metal Powder Production By Direct Reduction In An Arc Heater", Ser. No. 557,154, filed Mar. 10, 1975.

BACKGROUND OF THE INVENTION

1. Field of the Invention

This invention relates to a process for the direct reduction of metal oxide to powder particles of the metal in an arc heated plasma gas.

2. Description of the Prior Art

In the metal fabrication industry there is a sustained need for metal powders. For example, there is an increasingly large demand for powders used in the fabrication of small refractory metal items.

It is desirable to produce the metal powder from an ore which is provided in a finely divided form so that the metal is produced in a small particle form and is thereby available for fabrication of small parts. Prior attempts to produce metal powder in the desired form directly from metal ore have been less than satisfactory.

SUMMARY OF THE INVENTION

In accordance with this invention, it has been found that the problems inherent in prior attempts to produce metal powders may be overcome by the steps of introducing a finely divided ore consisting essentially of an oxide of at least one metal into the arc heated plasma gas of reducing atmosphere to reduce the oxide in the ore directly to small elemental metal solid particles, the melting point of the metal being greater than the chemical reduction reaction, and then cooling the particles to a temperature below that at which they would reoxidize.

The advantage of the process of this invention is that powdered ores may be reduced in an arc heater in a fast moving gas stream to solid metal particles which when cooled are available for fabrication of small metal parts.

DESCRIPTION OF THE PREFERRED EMBODIMENT

In accordance with the present invention, the process is carried out in the following sequential manner:

1. Introducing an ore of finely divided particles consisting essentially of an oxide of the metal to be produced into an arc heated plasma gas in a reducing atmosphere, such as methane, to effect reduction of the oxide to small particles of elemental metal, and 2. cooling the particles of elemental metal by a non-oxidizing gas to a temperature below which they will not stick together.

Figure 1:
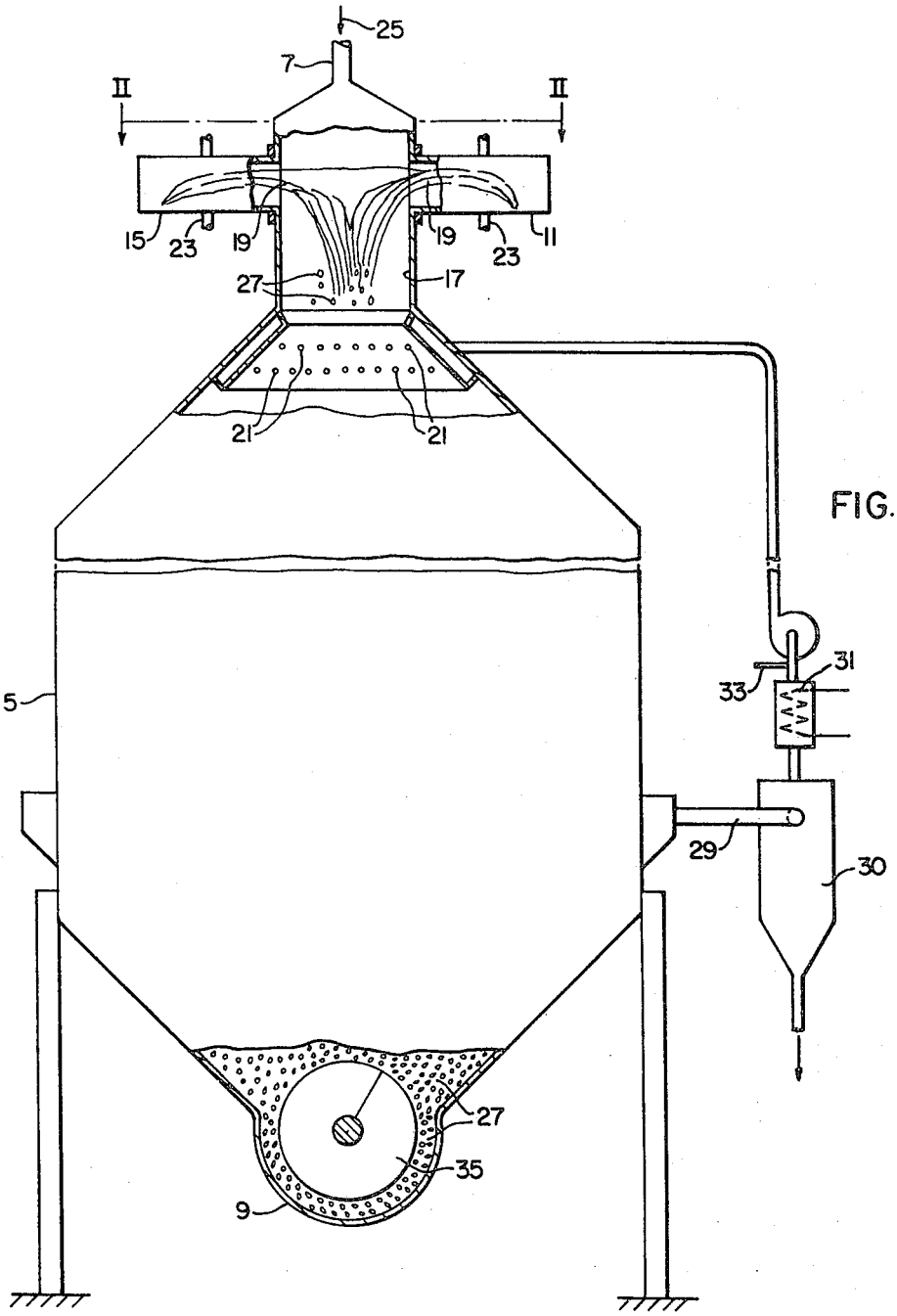
FIG. 1 is a diagrammatic view of a device for practicing the process of this invention.
Figure 2:
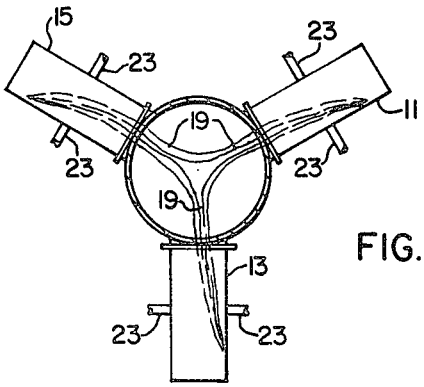
FIG. 2 is a horizontal sectional view taken on the line II—II of FIG. 1.

The process of this invention may be carried out in a structure characterized by that shown in FIG. 1 in which a reactor or collecting vessel 5 is provided with an inlet 7 at the upper end and an outlet 9 at the lower end. The structure also comprises arc heater means including at least one and preferably three arc heaters 11, 13, 15 (FIG. 2). The reactor or vessel 5 is composed of a suitable material, such as metal, the upper end of which includes a reduced cylindrical portion or chamber 17 with which the inlet 7 communicates. The exit ends of the arc heaters 11, 13, 15 (FIG. 2) likewise communicate with the plenum chamber 17 so that similar plasma jet streams 19 extend from each of the arc heaters into the plenum chamber. In addition, quenching means such as spray nozzles 21 are disposed in spaced relation around the vessel 5 and below the positions of the arc heaters 11, 13, 15 whereby a fluid or quenching material, such as an inert gas, is injected into the vessel 5.

The arc heaters 11, 13, 15 are similar in construction and operation to that disclosed in U.S. Pat. No. 3,765,870, entitled "Method of Direct Ore Reduction Using A Short Gap Arc Heater" of which the inventors are Maurice G. Fey and George A. Kemeny. Because of the full disclosure in that patent, the description of the arc heaters 11, 13, 15 is limited herein to the basic structure and operation. The arc heaters 11, 13, 15 (FIG. 2) are each a single phase, self-stabilizing AC device capable of power levels up to about 3500 kilowatts or up to about 10,000 kilowatt for a three phase plant installation. In the practice of this invention, it is preferred that three arc heaters be provided, one for each of the three phases of the AC power supply. Two arc heaters 11, 15 are shown in FIG. 1.

During operation of the arc heaters 11, 13, 15 a reducing gas, such as methane, is introduced into the arc heaters through peripherally disposed inlets 23 which gas comprises a greater portion of the plasma jet streams that enter the chamber 17.

Finely divided ore 25, such as molybdenum oxide ($MoO_3$), is introduced into the plenum chamber 17 via the inlet 7. In the plenum chamber 17, the ore 25 enters the plasma jet stream 19 where, in the presence of the reducing gas atmosphere (methane), the ore is reduced to elemental metal, for example, molybdenum. Upon reduction of the ore to the elemental metal state, small particles of the solid metal form and drop from the reaction chamber to the lower end of the vessel 5.

In accordance with this invention, the particles 27 of metal pass through a cooling zone which comprises jets of reducing gas, such as a mixture of CO and $H_2$, emitted into the vessel 5 through the spaced nozzles 21 which reducing gas is introduced through the nozzles at temperatures considerably below the reaction temperature of the elemental metal. Additional cooling occurs by radiation of the hot solid particles 27 to the cold walls of the vessel 5. The temperatures of the coolant reducing gas is sufficiently low to completely cool the particles 27 before they reach the bottom of the vessel 5 to avoid reoxidation of the particles, or sticking together, upon removal from the chamber and to enable easy handling.

As an alternative the particles 27 of metal may be cooled by providing for cooling of the gas as it passes through an expansion nozzle (not shown) at the chamber exit. As a further alternative the particles may be cooled by passing through a nozzle and then through the gas atmosphere as set forth above. The gas and solids pass through the expansion nozzle. As the gas is cooled by expansion, the entrained particles transfer a portion of their sensible heat to the gas.

The reaction of the metal oxide or ore with a reductant, such as methane ($CH_4$), is shown in the following formula:

$$MoO_3 + 3CH_4 \rightarrow Mo + 3CO + 6H_2$$

The carbon monoxide and hydrogen gas mixture resulting from the reaction are removed from the vessel 5 through an outlet conduit 29 which conduit passes through a cyclone particle separator 30 and then a coil 31 of the heat exchanger for withdrawing the heat from the gases, a portion of which gases are then returned to the nozzles 21 and the balance is removed from the system through a vent 33. As the metal particles collect at the bottom of the vessel 5, they may be withdrawn through the outlet 9 in a suitable manner such as by a screw conveyor 35.

In conclusion, the foregoing process provides a means for the production of metal powder directly from an ore in an arc heater. Although an example for the production of molybdenum is disclosed, it is understood that other metals, having melting points greater than the temperature of the chemical reduction reaction, such as tantalum, molybdenum, tungsten and nibium may likewise be produced in metal powder form. The demand for metal powders is high. Provided the ore is in a finely divided form, the metal produced is also in small particle form and has only to be cooled. This procedure is distinguished from many powder making processes.

What is claimed is:

1. A process for producing metal powder by direct reduction of an ore, comprising the steps of introducing a finely divided ore consisting essentially of an oxide of the metal into an arc-heated plasma gas to effect direct reduction of the oxide to small elemental solid metal particles, the elemental metal having a melting temperature greater than the temperature of the chemical reduction reaction, and cooling the reduced elemental metal particles by cooling the gas as it flows through an expansion nozzle.

* * * * *